US006905448B1

(12) United States Patent
Blaker

(10) Patent No.: US 6,905,448 B1
(45) Date of Patent: Jun. 14, 2005

(54) PORTABLE FOLDABLE EXERCISE DEVICE

(76) Inventor: Chance B. Blaker, 14016 Bora Bora Way Apt. G 208, Marina Del Rey, CA (US) 90292-6889

( * ) Notice: Subject to any disclaimer, the term of this patent is extended or adjusted under 35 U.S.C. 154(b) by 371 days.

(21) Appl. No.: 10/268,217

(22) Filed: Oct. 9, 2002

(51) Int. Cl.[7] ..... A63B 21/00
(52) U.S. Cl. ..... 482/126; 482/121; 482/907; 482/127
(58) Field of Search ..... 482/44, 139, 110, 482/121–130, 49

(56) References Cited

U.S. PATENT DOCUMENTS 2,806,699 A * 9/1957 Spooner ..... 482/126
4,268,032 A * 5/1981 Cusi ..... 482/126
4,629,186 A * 12/1986 Aldridge ..... 482/126
5,031,906 A * 7/1991 Jang ..... 482/125
5,993,361 A * 11/1999 Paoli et al. ..... 482/121
6,733,427 B1 * 5/2004 He ..... 482/122

* cited by examiner

*Primary Examiner*—Jerome W. Donnelly
(74) *Attorney, Agent, or Firm*—Allan M. Shapiro

(57) ABSTRACT

The portable flexible exercise device is a quadrilateral with handles at the corners. Compression members extend between the adjacent handles and are pivoted thereto. A tension member is engaged so that one pair of opposite handles is resiliently urged apart while the other pair is resiliently urged together so that the exercise device can be utilized in different forms of exercise.

20 Claims, 4 Drawing Sheets

FIG. 2
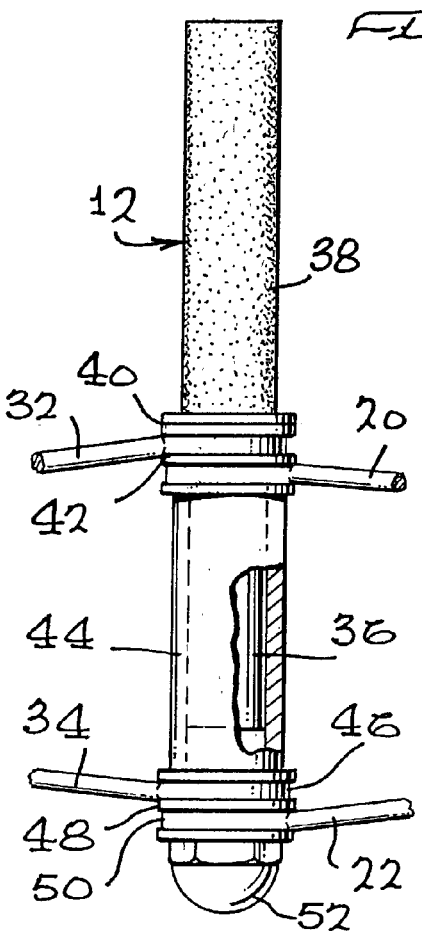
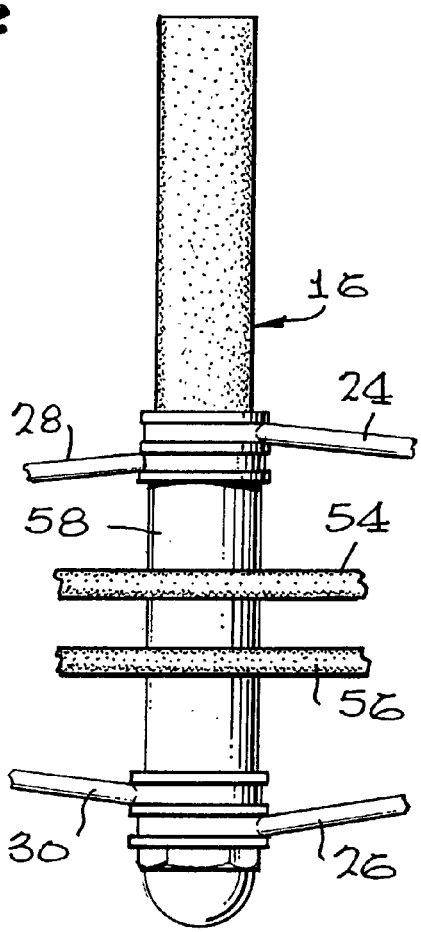
FIG. 3
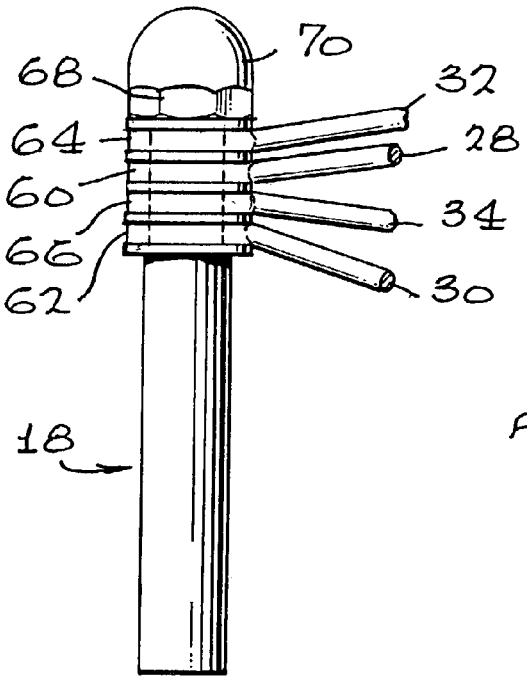
FIG. 4

FIG. 5
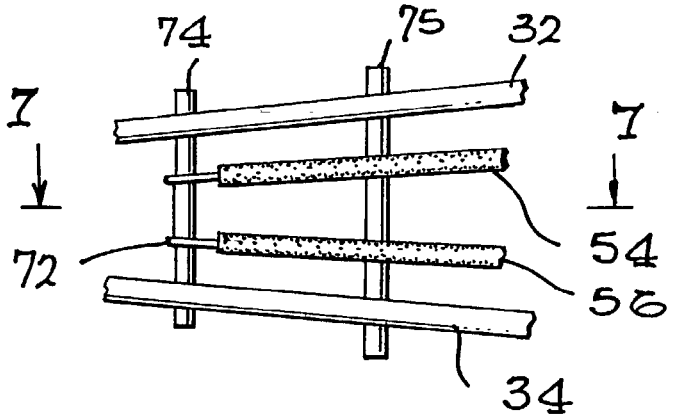
FIG. 6
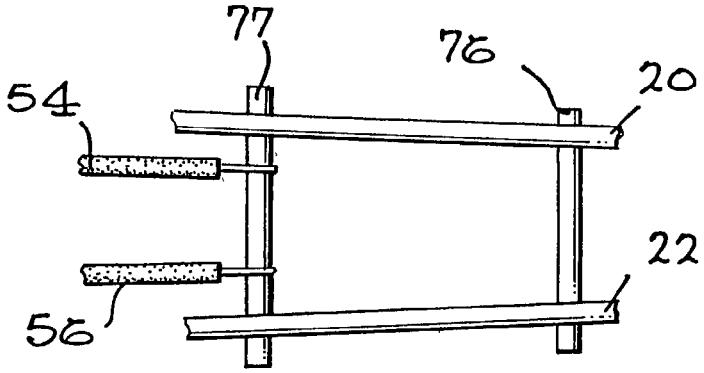
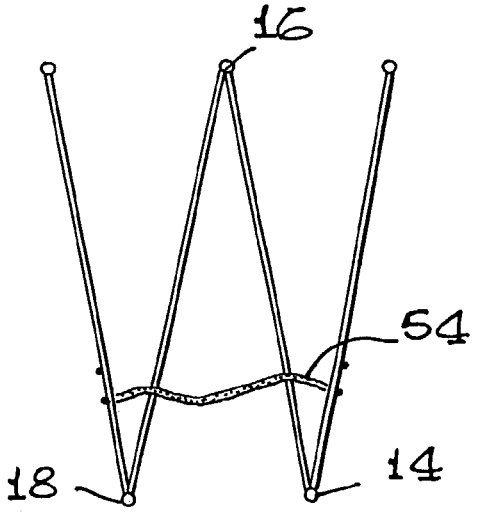
FIG. 8

PORTABLE FOLDABLE EXERCISE DEVICE

FIELD OF THE INVENTION

This invention is directed to an exercise device which is light, conveniently small and foldable. The exercise device is capable of compression and tension type exercises.

BACKGROUND OF THE INVENTION

The human body is configured and muscled to do physical work. Prior to the twentieth century, virtually all physical work was accomplished by human physical activity, supplemented by animal effort guided by the human. Toward the end of the nineteenth century and particularly in the first half the twentieth century, modern machinery has replaced most of the hardest physical work which was previously done by human effort. For example, in the nineteenth century, a plow was pulled by a horse or mule, but a man walked behind controlling the animal through reins and controlling the plow through handlebars. Today's farmer plows from the seat of a tractor. Quite often he has power steering on the tractor so that even that effort is minimized.

The result has been that man does not get enough physical exercise to maintain the optimum condition of the body. The first point of exercise is to work particular muscles so that they are strengthened. The secondary result is that this muscular activity demands increased heart rate to bring nutrients to the muscle and take away the waste products. The lung activity is also increased to remove the carbon dioxide from the blood and oxygenate the blood. This increased respiratory and circulatory activity is also good for the entire body by increasing the circulation. The result of this combination is improved physical condition.

In order to maintain this good physical condition, it would be useful to have a portable exercise device which can be carried with the user so that it is conveniently available when he has the time and desire to do physical exercises.

SUMMARY OF THE INVENTION

In order to aid in the understanding of this invention, it can be stated in essentially summary form that it is directed to a portable foldable exercise device. The exercise device is in the form of a quadrilateral having handles at all four corners. Compression members connect the adjacent corners, all the way around. The compression members are pivoted at the corners. There is a handle at each of the corners. A resilient tension member is engaged between two sets of compression members, away from the handles so that one pair of opposite handles can be moved toward each other against resilient stress and the other pair of opposite handles can be moved apart from each other against resilient stress.

It is thus a purpose and advantage of this invention to provide a portable foldable exercise device which is compact so it can be easily carried along, but provides both tension and compression exercise opportunities.

It is another purpose and advantage of this invention to provide a portable foldable exercise device which can be folded into a convenient small package.

It is a further purpose and advantage of this invention to provide a portable foldable exercise device which can be used by anyone for a plurality of exercises which require handles to be pulled apart against stress and/or require handles to be pushed together against stress.

The features of this invention which are believed to be novel are set forth with particularity in the appended claims.

The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 2 is an enlarged view of one of the handles of the portable foldable exercise device, with parts broken away and parts taken in section.

FIG. 3 is an enlarged view of the handle opposite to the handle of FIG. 2, with parts broken away.

FIG. 4 is an enlarged side elevational view of one of the handles adjacent the handle of FIG. 2.

FIG. 5 is an enlarged side elevational view showing the attachment of the resilient member to a compression member.

FIG. 6 is a view similar to FIG. 5 showing the connection of the opposite end of the compression member.

FIG. 8 is a plan view of the portable foldable exercise device with one handle removed and shown in the folded position.

DESCRIPTION OF THE PREFERRED EMBODIMENTS

Figure 1:
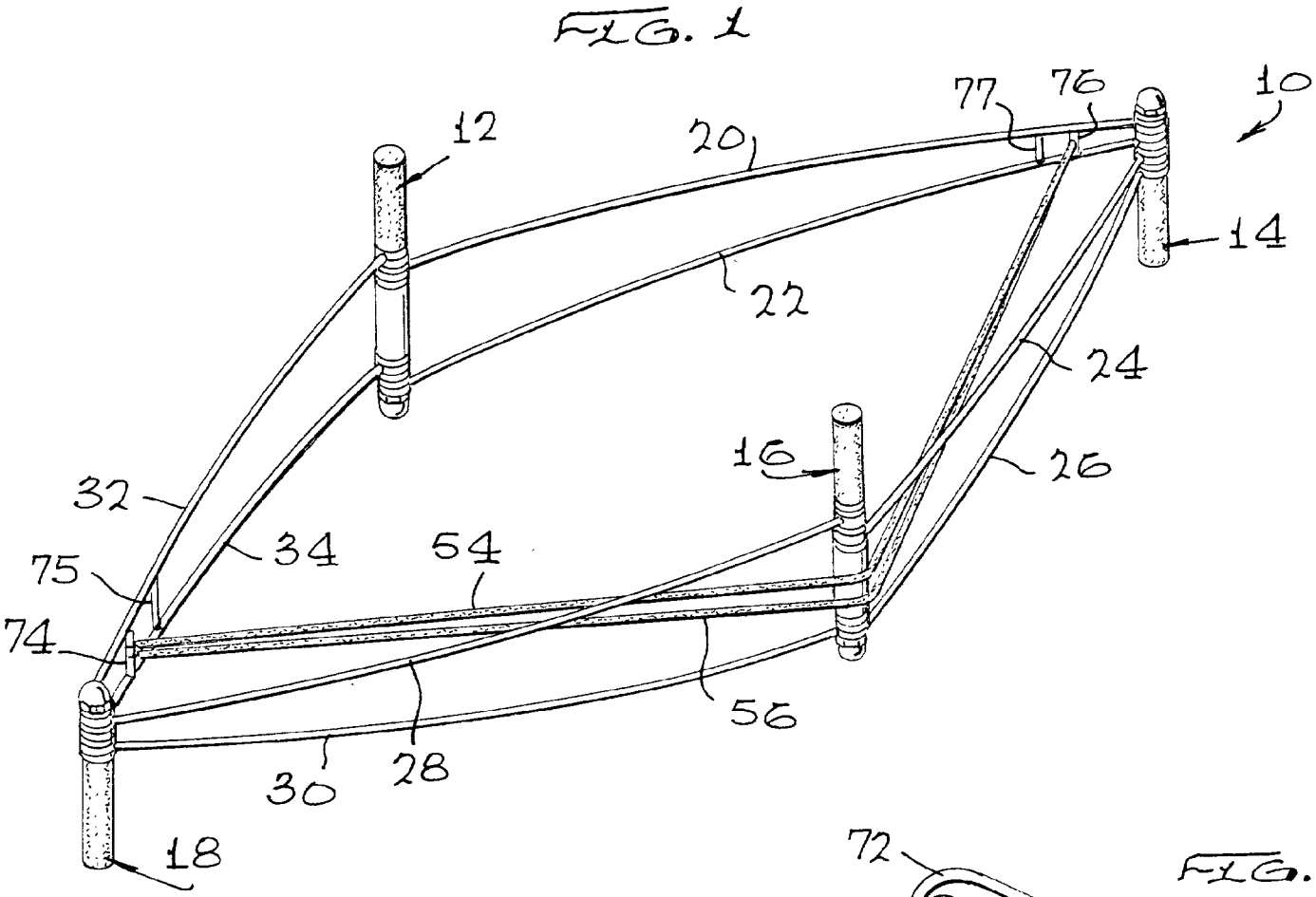
FIG. 1 is a perspective view of the portable foldable exercise device of this invention.
Figure 9:
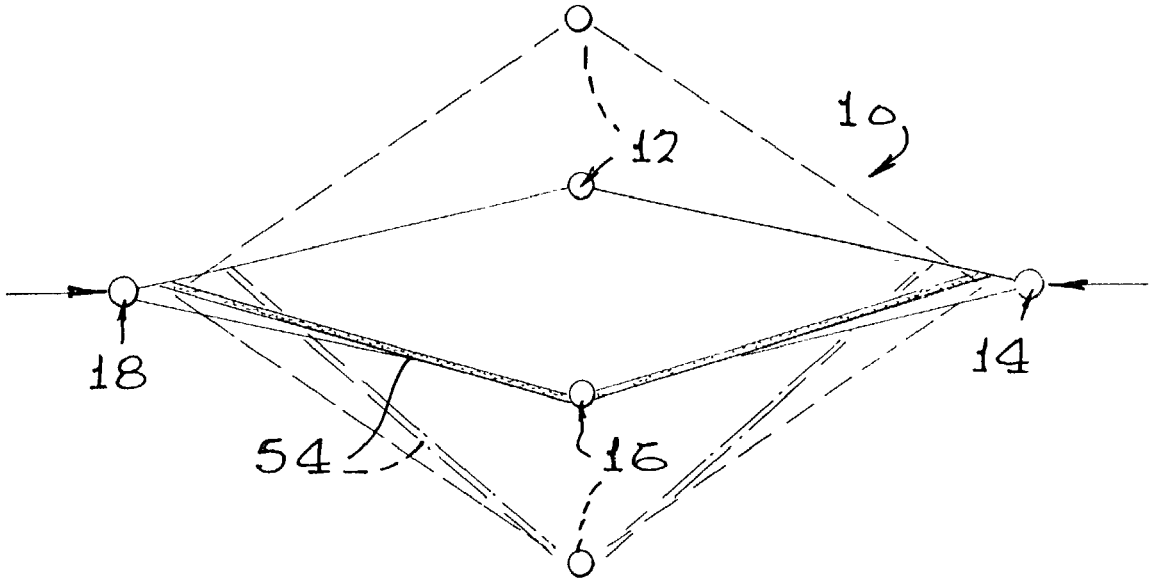
FIG. 9 is a diagrammatic plan view illustrating the manner in which the exercise device is used for exercises which require forces toward each other.
Figure 10:
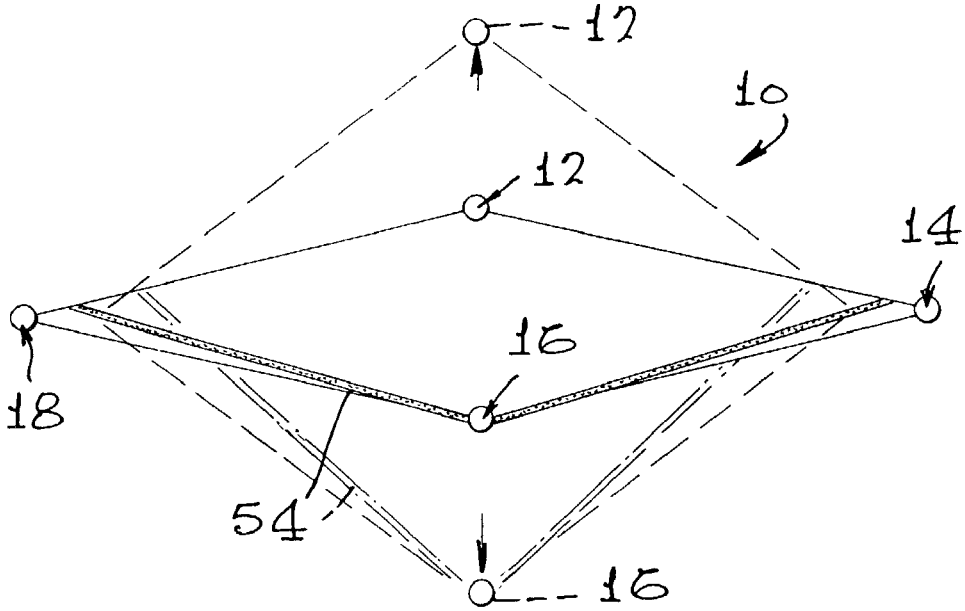
FIG. 10 is a diagrammatic plan view showing how the exercise device is used for exercises which require forces away from each other.

The portable foldable exercise device of this invention is generally indicated at 10 in FIGS. 1, 9 and 10. The device 10 is a quadrilateral having four handles, one at each corner. Handles 12, 14, 16 and 18 are seen in FIGS. 1, 9 and 10. Two compression members are connected between each handle and its adjacent two handles. The compression members are preferably metallic or molded plastic rods which are stiff enough to withstand the compression load and/or torque load exerted between the handles. Compression members 20 and 22 are connected between handles 12 and 14. Compression members 24 and 26 are connected between handles 14 and 16. Compression members 28 and 30 are connected between handles 16 and 18. Compression members 32 and 34 are connected between handles 18 and 12.

FIG. 2 shows the compression members 20, 22, 32 and 34 wrapped around the central rod 36 of handle 12. The central rod carries hand grip 38 against which washer 40 bears. The loop on compression member 32 is engaged around rod 36. Washer 42 spaces the loop on the end of compression member 20 from compression member 32. Collar 44 engages around the central rod 36 and acts as a long washer to space the loop 46 on the end of compression member 34 from the loop on compression member 20. Washer 48 spaces the loop 46 from the loop 50 on the end of compression member 22. Nut 52 threadedly engages the end of central rod 36 so that the entire structure can be disassembled. Each of the compression members has a circular loop formed on its end. The interior of the loop is sized so that it freely rotates on control rod 36, but minimum end freedom is permitted. When the other ends of the compression members are properly constrained, the handle 12 stands up, as shown in FIG. 2. Handle 16, as seen in FIG. 3, is of the same construction. In addition, the handle 16 has two tension members 54 and 56 on the outside of and in contact with its collar 58. The handles 12 and 16 are at opposite corners of the quadrilateral as seen in FIG. 1.

Handles 14 and 18 are each between handles 12 and 16, also at opposite corners of the quadrilateral. Handle 18 is seen in detail in FIG. 4. Handle 14 is identical. As seen in FIGS. 1 and 4, compression members 28, 30, 32 and 34 respectively have loops 60, 62, 64 and 66 formed on the ends thereof. The interior of the loops is sized to freely fit on the central rod 68 of the handle 18. The lower end of the handle has a hand grip thereon which acts as a stop for the loops and washers thereon. The stop on the other end is formed by nut 70 which is threadedly attached to the top end of the control rod above the loops and washers.

This construction defines an exercise device in which the handles 14 and 18 move toward each other when the handles 12 and 16 move away from each other, and vice versa.

The exercise device 10 is configured, as seen in FIG. 1, with the handles 12 and 16 pointed up when the handles 14 and 18 are pointed down. This aids in its utilization in certain of the exercises, such as where adjacent handles are both employed for different conditions of body engagement.

Figure 7:
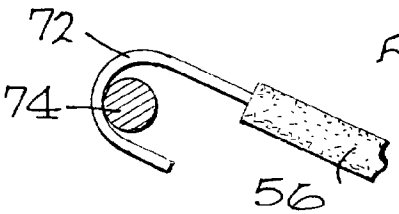
FIG. 7 is a view showing the attachment of the end of the tension member to the compression members.

In order to provide exercise resistance and resiliency to this motion, tension members 54 and 56 are provided. The tension members may be rubber-like synthetic polymer material cord, commonly known as bungee cord. They are provided with a hook at each end. Hook 72 is shown on tension member 56 in FIGS. 5 and 7. Crossbars 74 and 76 are shown in FIG. 1 and crossbar 74 is shown in FIG. 5. The crossbars are of the same construction. As seen in FIGS. 1 and 5, the crossbar 74 is attached across the compression members 32 and 34 to provide a place upon which the end of the tension member can be hooked. The crossbar 76 is similar, and is attached across compression members 20 and 22 close to handle 14. The crossbar 74 is attached to its compression members 32 and 34 close to the handle 18.

In order to provide a selection of resistance force provided by the bungee cords 54 and 56, two crossbars are provided at each end. Crossbars 74 and 75 are shown in FIG. 5 and crossbars 76 and 77 are shown in FIG. 6. Crossbar 75 is positioned at about half the distance from crossbar 74 as crossbar 77 is positioned from crossbar 76. This provides for four selections of bungee tension. On the outside crossbars 74 and 76, maximum bungee cord tension is provided. Between crossbars 75 and 77, minimum bungee cord tension is provided. When the bungee cords are connected between crossbars 74 and 77 or between crossbars 75 and 76, intermediate levels of bungee cord tension are provided. The bungee cord tension members extend around the outside of handle 16. When the handles 12 and 16 are grasped and moved apart, the tension members stretch. When the handles 14 and 18 are moved toward each other, the tension members stretch.

There are various exercise usages. For example, in one use, the handles 14 and 18 are grasped with the hands in front of the body and the handles 14 and 18 are moved toward each other to provide a first chest exercise. In a second chest exercise, the handles 14 and 18 are grasped, one in each hand, with the arms overlapped, and the arms are pulled outward to pull the hands together. In a first shoulder exercise, the handle 16 is held against the side of the torso at the waist with the handle facing forward. This is held in place by the arm reaching in front of the torso. The other hand grasps the handle 12 and pulls it outward and upward so that the compression members 24 and 26 continue to lie against the side of the torso from waist to armpit.

As an example of a leg muscle exercise, the exercise device 10 lies across the top of the user's thighs as he sits down, with handles 12 and 16 engaging downwardly over the thighs behind the user's knees. Muscular separation of the knees spreads these handles to exercise the outer thigh. The inner thigh is exercised by the user while he is in a seated position with the handles 14 and 18 engaging the user's thigh just above his knees. Bringing the thighs together stretches the tension member to provide the necessary exercise resistance.

For utilization of the exercise device 10 as a triceps exercise, one of the handles 12 or 16 which are tensioned together is held, for example, by the right hand at the right shoulder. The left hand grasps the opposite handle and pulls away to the left from the right shoulder, exercising the left triceps muscles. The opposite triceps muscles can be exercised by holding one of those handles with the left arm in front of the left shoulder, to exercise the right triceps muscles.

For biceps exercise, the handle 16 is engaged underneath and behind the knee of the sedentary exerciser. The hand on the same side engages the handle 12. Raising the arm and bending the elbow causes extension of the tension members to provide the necessary exercise resistance. These are examples of the many ways in which the exercise device 10 can be utilized to provide the necessary resistance for effective exercise.

FIGS. 9 and 10 show the geometry of the exercise device 10 as it is moved from one position to another. FIG. 9 shows that forces toward each other at handles 14 and 18 cause the handles to move toward each other against the resistance provided by the tension members. FIG. 10 shows that outward force against the handles 12 and 16 permit those handles to move away from each other against the force provided by the tension member.

The portability of the exercise device 10 is very important. It is small as compared to most exercise devices and it is eminently useful for various exercises when the distance between the handles 14 and 18, at maximum distance, is only about three feet. Even three feet is large when the user is planning on packing the exercise device for a trip. To reduce its size during packing, the handle 12, see FIG. 2, can be disassembled. The nut 52 is removed from the control rod 36 and the loops from the compression members, washer and collar 44 are removed. As seen in FIG. 8, this permits the exercise device to be folded in a "W" shape, with the handle 16 adjacent the loops on the handle 12 and the compression members 20, 22, 32 and 34. In this configuration, the folded exercise device is capable of being packed into a suitcase. The exercise device can be reassembled at a destination for further exercise utilization.

This invention has been described in its presently contemplated best modes and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An exercise device comprising:

first, second, third and fourth manually engageable handles;

a first compression member engaged between said first and second handles, a second compression member engaged between said second and third handles, a third compression member engaged between said third and fourth handles and a fourth compression member engaged between said fourth and first handles, each of said compression members being rotatably engaged on at least one of its handles;

first engagement structure on said first compression member and second engagement structure on said fourth compression member; and a tension member engaging said first and second engagement structures and engaging said third handle so that, as said second and fourth handles are moved toward each other, said tension member is extended to act against manually applied force.

2. The exercise device of claim 1 wherein said tension member has first and second ends and at least one of said ends has a hook thereon, said hook engaging said first engagement structure.

3. The exercise device of claim 2 wherein said tension member has a bungee cord.

4. The exercise device of claim 1 wherein said compression members each comprise a rod having a first and a second end, at least one of said first and second ends of each said compression member having a loop formed thereon, said loop engaging one of said handles and being rotatable with respect to said handle with which it is engaged.

5. The exercise device of claim 4 wherein each of said compression members has a loop on each of its first and second ends, each of said loops being configured to be engaged on and rotatable with respect to said manually engageable handle at that end of said compression member.

6. The exercise device of claim 5 wherein said tension member has first and second ends and at least one of said ends has a hook thereon, said hook engaging said engagement member on said compression member between said first and second handles.

7. The exercise device of claim 5 wherein at least one of said compression members comprises a pair of spaced rods, each of said rods having a first and a second end and each of said rods having a loop formed at both its first and second ends.

8. The exercise device of claim 5 wherein said first compression member comprises a pair of spaced rods, said second compression member comprises a pair of spaced rods, said third compression member comprises a pair of spaced rods and said fourth compression member comprises a pair of spaced rods.

9. The exercise device of claim 8 wherein at least one end of each of said pair of spaced rods has a loop formed therein and said handle engaged by said compression member is rotatably mounted with respect to said loop so that said exercise device is a quadrilateral configured so that its opposite corners can move toward and away from each other.

10. The exercise device of claim 9 wherein said tension member has first and second ends and at least one of said ends has a hook thereon, said hook engaging said first engagement structure.

11. An exercise device comprising:

a first handle, a second handle, a third handle and a fourth handle;

a first compression member engaged with both said first and second handles and rotatably attached to at least one of said first and second handles;

a second compression member engaged with both said second and third handles and rotatably attached to at least one of said second and third handles;

a third compression member engaged with both said third and fourth handles and rotatably attached to at least one of said third and fourth handles;

a fourth compression member engaged with both said fourth and first handles and rotatably attached to at least one of said first and fourth handles so that said first and third handles can move toward and away from each other while said second and fourth handles move away and toward each other, respectively, as said quadratic exercise device is moved; and a resilient member attached to resiliently urge said first and third handles toward each other.

12. The exercise device of claim 11 wherein said compression members define a plane through said handles, and said first and third handles extend above said plane and said second and fourth handles extend below said plane.

13. The exercise device of claim 11 wherein said compression members each have a loop formed on at least one end thereof with said loop engaging a handle so that said handle is rotatable with respect to said compression member.

14. The exercise device of claim 13 wherein at least some of said compression members have a loop formed on each end thereof, with said loops respectively being rotatably engaged on the handle at said end of said compression member.

15. The exercise device of claim 11 wherein each said handle has a central rod therein and a hand grip on said central rod, at least some of said compression members being rotatably attached to said central rod.

16. The exercise device of claim 15 wherein each of said compression members has a loop on each end thereof, said loops being engaged over said central rods of said handles.

17. The exercise device of claim 15 wherein said compression members each comprise a pair of compression rods and each of said compression rods has a loop formed on each end thereof, said loops being engaged on said central rods so that said handles are rotatable with respect to said compression members.

18. The exercise device of claim 17 wherein said loops of said compression members are spaced on said first and third central rods, with a collar therebetween.

19. The exercise device of claim 18 wherein said resilient member is a tension member which is attached to said first and fourth compression members and engages around said third handle.

20. The exercise device of claim 19 wherein said tension member is a bungee cord engaged on a crossbar on each of said first and fourth compression members.

* * * * *